US006631249B2

(12) United States Patent
Katsumi et al.

(10) Patent No.: US 6,631,249 B2
(45) Date of Patent: Oct. 7, 2003

(54) IMAGE FORMING APPARATUS CAPABLE OF PREVENTING THE OVERFLOW OF TONER ON A CLEAN BLADE

(75) Inventors: Toru Katsumi, Ibaraki (JP); Haruhiko Omata, Ibaraki (JP); Shinya Suzuki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/964,646

(22) Filed: Sep. 28, 2001

(65) Prior Publication Data

US 2002/0044798 A1 Apr. 18, 2002

(30) Foreign Application Priority Data

Sep. 29, 2000 (JP) ..... 2000-300168

(51) Int. Cl.[7] ..... G03G 21/00; G03G 15/00
(52) U.S. Cl. ..... 399/71; 399/101; 399/302
(58) Field of Search ..... 399/101, 44, 98, 399/99, 297, 343, 350, 302, 308, 71

(56) References Cited

U.S. PATENT DOCUMENTS 5,742,873 A * 4/1998 Kubo et al. ..... 399/101
5,870,650 A * 2/1999 Takahashi et al. ..... 399/101
5,881,339 A * 3/1999 Yanagida et al. ..... 399/101
5,893,022 A * 4/1999 Yoshino et al. ..... 399/302 X
6,032,006 A * 2/2000 Yanagida ..... 399/101

* cited by examiner

*Primary Examiner*—Sophia S. Chen
(74) *Attorney, Agent, or Firm*—Fitzpatrick, Cella, Harper & Scinto

(57) ABSTRACT

An apparatus including: an image forming portion; a recording-material transporting member; a cleaning portion; a fixing portion equipped with a fixing member coated with a mold release agent; and a controller. The apparatus can perform two-sided copying by transferring and fixing an image on a first surface of recording material, and then transferring and fixing an image on an opposite surface. A cleaning blade in the cleaning portion abuts the recording material transport means and a normal line of a surface of the cleaning blade is substantially directed to a gravity direction, and faces an upstream side of an abutting portion of the cleaning blade in a transportation direction of the recording-material transporting member, wherein the surface of the cleaning blade facing an upstream side of an abutting position in a transportation direction faces a direction opposite to the gravity direction.

39 Claims, 12 Drawing Sheets

FIG. 11

| | TONER SUPPLY POINT [SHEETS] | 100 | 200 | 300 | 400 | 500 | 600 | 700 | 800 |
|---|---|---|---|---|---|---|---|---|---|
| DENSITY LEVEL | AFTER ONE HUNDRED SHEETS FOR TWO-SIDE PRINTING | 64 | 56 | 48 | 40 | 32 | 16 | 0 | 0 |
| | AFTER FIFTY SHEETS FOR TWO-SIDE PRINTING | 56 | 48 | 40 | 32 | 16 | 0 | 0 | 0 |
| | AFTER TEN SHEETS FOR TWO-SIDE PRINTING | 48 | 40 | 32 | 6 | 0 | 0 | 0 | 0 |

IMAGE FORMING APPARATUS CAPABLE OF PREVENTING THE OVERFLOW OF TONER ON A CLEAN BLADE

BACKGROUND OF THE INVENTION

1. Field of the Invention

The present invention relates to an image forming apparatus capable of duplex image formation by performing image formation on one side of a recording material first and then by performing image formation on the back side of the same recording material also by an electrophotographic process.

2. Description of the Related Art

Conventionally various kinds of image forming apparatus commonly including features like the following are proposed. The apparatus are equipped with a plurality of image forming portions adopting an electrophotographic process. Each image forming portion forms a toner image having a different color from each other. The toner images are sequentially superimposed on each other on the same recording material by being transferred to form a color image on the recording material. Furthermore, a color copying machine for performing color high-speed recording was proposed as an image forming apparatus. The machine is equipped with a transfer belt being a recording-material transporting member in a shape of an endless belt, and a plurality of image forming portions arranged in a straight line along the transfer belt.

A brief description of an example of the color copying machine is given on the basis of FIG. 1. In the machine, a first, a second, a third and a fourth image forming portions Pa, Pb, Pc and Pd are disposed. The image forming portions Pa, Pb, Pc and Pd are equipped with electrophotographic photosensitive drums 3 (3*a*, 3*b*, 3*c*, 3*d*) being respectively image bearing members for their respective exclusive use, and each color toner image is formed on each photosensitive drum 3. A transfer belt (recording material transportation member in the shape of a belt) 30 adjoining each photosensitive drum 3 is disposed. Each color toner image formed on each photosensitive drum 3 is superimposed on each other to be transformed on a recording material P to be transported by the transfer belt 30. After the recording material P, on which each color toner image is transferred, is heated and pressurized by a fixing device 9, the recording material P is delivered to the outside of the machine as a recording material P bearing a color recorded image.

In such an image forming apparatus, mold releasing oil (also called as "fixing oil") such as dimethyl silicone oil is reserved in an oil reservoir 53 for the prevention of the adherence of the toner on a recording material to a fixing roller 51 of the fixing device 9, and the mold releasing oil is coated on the surface of the fixing roller 51 with a coating roller 50.

Moreover, because toner smear (mainly consisting of untransferred residual toner (called as "fogging toner") transferred from the photosensitive drums 3 to the transfer belt 30, and also including paper dust and the like as a part) exist on the transfer belt 30 that has finished transferring, the toner smear is scraped off by the abutting of a cleaning blade 8*a* that is made from an elastic material such as rubber and is fixed on a transfer belt cleaner 8 against the transfer belt 30, and the scraped toner is collected into the cleaner 8.

In the configuration shown in FIG. 1, the cleaning blade 8*a* is disposed such that the edge surface (a surface parallel to the thickness direction of the blade 8*a* from the abutting portion of the blade 8*a* against the transfer belt 30) of the blade 8*a* faces toward upward in the gravity direction.

Such a disposition of the cleaning blade 8*a* makes it easy to hold toner on the edge surface of the blade 8*a*, and the holding of the toner makes it possible to realize a stable slidableness at the abutting portion against the transfer belt 30, and also makes it possible to improve the cleaning performance partly owing to the addition of the polishing effect of the toner.

However, in the case where images are formed on two sides of a recording material in such an image forming apparatus, there is the possibility that toner excessively accumulates on the edge surface of the blade 8*a* to overflow upwards from the cleaner 8. The overflowed toner adheres to the back side of the recording material to become back side smear, or disperses in the apparatus to smear the inside of the apparatus.

The present inventor's studies reveal the following cause of the accumulation of the toner on the edge surface of the blade 8*a*. That is, after images have been formed on one side of a recording material and then the formed images have been fixed by the fixing device 9, when the recording material is turned over and borne on the transfer belt 30 again for the image-forming on the back side (second side), the oil, which had been coated on the fixing roller 51 and was adhered to the front side (first side) of the recording material at the time of fixation, adheres to the transfer belt 30 to be carried to the cleaning blade 8*a*. Consequently, when the smear toner on the transfer belt 30 is carried to the blade 8*a*, the toner being powder is mixed with the oil to be clayey. The clayey toner accumulates on the edge surface of the blade 8*a*.

Even if the image forming apparatus is one adopting the so-called intermediate transfer process in which toner images on a photosensitive drum is once transferred on an intermediate transfer member and then the images are transferred from the intermediate transfer member to a recording material, the aforesaid problem occurs when the cleaning device having the aforesaid configuration is used.

SUMMARY OF THE INVENTION

One object of the invention is to provide an image forming apparatus capable of preventing the overflow of toner owing to the excessive accumulation of the toner on a cleaning member for a recording material bearing member, intermediate transfer member or a transfer member, and capable of avoiding the troubles of the smearing in a machine, the back side smear of a recording material and the like.

For attaining the foregoing object, a preferable aspect of the invention comprises:

image forming means for forming a toner image;

a recording-material transporting member for bearing and transporting the recording material;

cleaning means equipped with a cleaning blade abutting against a surface of the recording-material transporting member; and fixing means equipped with a fixing member on which a mold release agent is coated, the apparatus being capable of forming an image on a surface of the recording material, a fixing operation of which has been performed by the fixing means, the surface of the recording material being opposite to a surface thereof on which the toner image is transferred, wherein:

the cleaning blade is arranged such that a normal line of a surface of the cleaning blade, which is close to an abutting portion against the recording-material transporting member and faces to an upstream side of a transportation direction of the recording-material transporting member against the abutting portion, is substantially directed to a gravity direction; and the apparatus further comprises control means for controlling the apparatus to transfer a supply toner image, which is to be fed to the cleaning means, formed by the image forming means on the recording-material transporting member directly, and to feed the supply toner image transferred on the recording-material transporting member to the cleaning means by transporting the recording-material transporting member.

Another preferable aspect of the invention comprises:

image forming means for forming a toner image;

an intermediate transfer member for bearing the toner image formed by the image forming means;

transferring means for transferring the toner image borne on the intermediate transfer member onto a recording material;

cleaning means equipped with a cleaning blade abutting against a surface of the intermediate transfer member; and fixing means equipped with a fixing member on which a mold release agent is coated, the apparatus being capable of forming an image on a surface of the recording material, a fixing operation of which has been performed by the fixing means, the surface of the recording material being opposite to a surface thereof on which the toner image is transferred, wherein:

the cleaning blade is arranged such that a normal line of a surface of the cleaning blade, which is close to an abutting portion against the intermediate transfer member and faces to an upstream side of a transportation direction of the intermediate transfer member against the abutting portion, is substantially directed to a gravity direction; and the apparatus further comprises control means for controlling the apparatus to bear a supply toner image, which is to be fed to the cleaning means, formed by the image forming means on the intermediate transfer member, and to feed the supply toner image borne by the intermediate transfer member to the cleaning means by transporting the intermediate transfer member.

A further preferable aspect of the invention comprises:

image forming means for forming a toner image;

a transfer member for transferring the toner image formed by the image forming means onto a recording material;

cleaning means equipped with a cleaning blade abutting against a surface of the recording-material transporting member; and fixing means equipped with a fixing member on which a mold release agent is coated, the apparatus being capable of forming an image on a surface of the recording material, a fixing operation of which has been performed by the fixing means, the surface of the recording material being opposite to a surface thereof on which the toner image is transferred, wherein:

the cleaning blade is arranged such that a normal line of a surface of the cleaning blade, which is close to an abutting portion against the transfer member and faces to an upstream side of a transportation direction of the transfer member against the abutting portion, is substantially directed to a gravity direction; and the apparatus further comprises control means for controlling the apparatus to transfer a supply toner image, which is to be fed to the cleaning means, formed by the image forming means on the transfer member directly, and to feed the toner image to the cleaning means by transporting the transfer member.

According to the present invention, toner images are directly formed periodically on a recording-material transporting member of recording materials, an intermediate transfer member or a transfer member in an image forming apparatus capable of two-side printing, and then the toner is fed to the cleaning blade of the recording-material transporting member of the recording materials, the cleaning blade of the intermediate transfer member or the cleaning blade of the transfer member. Consequently, the accumulation of toner on those cleaning blades, which accumulation is caused by the movement of oil adhered to the recording materials at the time of fixing to the recording-material transporting member, the intermediate transfer member or the transfer member, can be prevented. Thereby, the occurrence of the problems such as the smearing in the machine, the back side smear of the recording materials, and the like can be prevented.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which:

FIG. 11 is a table showing changes of the densities of supplied toner at the time of a one-side printing after a two-side printing;

DETAILED DESCRIPTION OF THE PREFERRED EMBODIMENTS

Hereafter, embodiments according to the present invention are described in conformity with the attached drawings further in detail.

Embodiment 1

Figure 1:
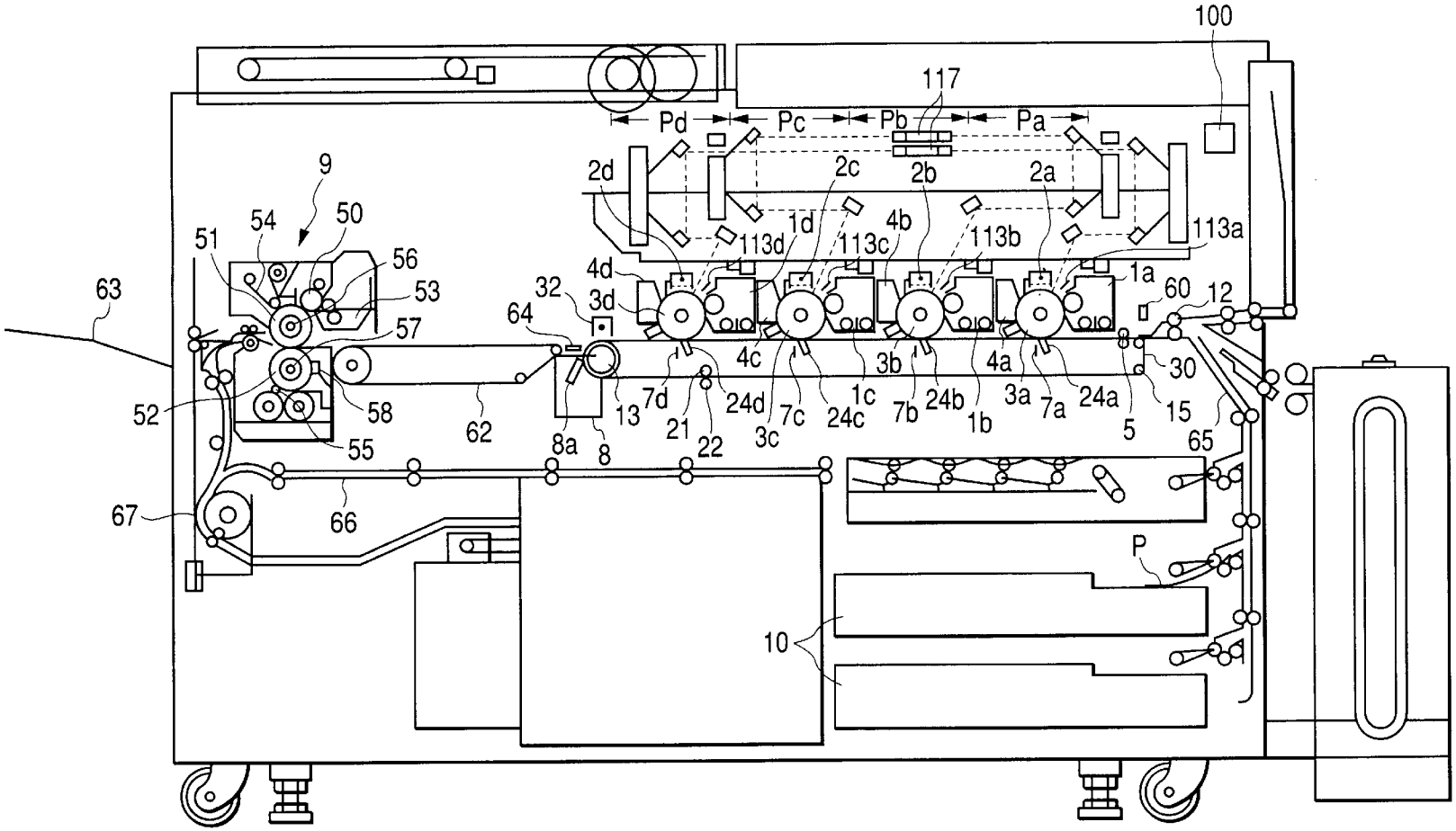
FIG. 1 is a schematic diagram showing the whole configuration of an embodiment of an image forming apparatus of the present invention.

FIG. 1 is a schematic diagram showing the whole configuration of an embodiment of an image forming apparatus of the present invention, and the embodiment is configured as a full color copying machine in four colors.

The present copying machine is equipped with the plural image forming portions Pa, Pb, Pc and Pd along the transfer belt 30 as a recording material transporting member in the machine. The image forming portions Pa, Pb, Pc and Pd include the photosensitive drums (drum-shaped electrophotographic photosensitive members) 3*a*, 3*b*, 3*c* and 3*d* as rotatable image bearing members. Chargers 2*a*, 2*b*, 2*c* and 2*d*, electro static voltmeters 113*a*, 113*b*, 113*c* and 113*d*, developing devices 1*a*, 1*b*, 1*c* and 1*d*, transfer chargers (blades) 24*a*, 24*b*, 24*c* and 24*d*, and drum cleaners 4*a*, 4*b*, 4*c* and 4*d* are provided around the photosensitive drums 3*a*, 3*b*, 3*c* and 3*d*, respectively. A light source device (not shown), and a polygon mirror 117 are disposed at an upper art of the machine.

After each photosensitive drum 3*a* to 3*d* is charged at a predetermined electric potential by the respective chargers 2*a* to 2*d*, a laser beam emitted by the light source device is reciprocated for scanning by the rotation of the polygon mirror 117. The luminous flux of the scanning beam is deflected with a reflecting mirror. Then, the reflected beam is condensed to the generatrices of the photosensitive drums 3*a* to 3*d* with a fθ lens (not shown) to expose them. Thereby, electrostatic latent images corresponding to image signals are formed on the photosensitive drums 3*a* to 3*d*.

The developing devices 1*a*, 1*b*, 1*c* and 1*d* are respectively filled with toners of cyan, magenta, yellow and black as developers up to a predetermined amount with a supply device (not shown). The developing devices 1*a*, 1*b*, 1*c* and 1*d* respectively develop the photosensitive drums 3*a*, 3*b*, 3*c* and 3*d* such that the latent images on the drums 3*a* to 3*d* are visualized as a cyan image, a magenta image, a yellow image and a black image.

Recording material cassette 10 in which the recording materials P are contained is disposed at a lower part of the machine. The recording materials P are carried from the cassettes 10 to registration rollers 12 through a transporting path 65 by a plurality of transportation rollers. The recording materials P are fed to the transfer belt 30 to be borne thereon. The recording materials P are further transported by the transfer belt 30 to transfer portions opposed to the photosensitive drums 3*a*, 3*b*, 3*c* and 3*d*.

The transfer belt 30 is made of a dielectric sheet composed of polyimide, polyethylene terephthalate (PET), polyvinylidene fluoride, polyurethane, or the like. The transfer belt 30 is formed to an endless shape by the superimposition of both the ends of the dielectric sheet on each other and by the joining of the superimposed portion. Or, a belt having no seam (seamless) is used as the transfer belt 30. Generally, such a transfer belt 30 has a volume resistivity of $10^{13}$ to $10^{18}$ Ωcm. The present embodiment uses the transfer belt 30 made of a polyimide resin.

The transfer belt 30 is installed by being supported by a driving roller 13 and a tension roller 15. When the transfer belt 30 is rotated by the driving of the driving roller 13 and it is ascertained that the transfer belt 30 positions at a predetermined position, a recording material P is fed from the registration rollers 12 to the transfer belt 30 and are borne on the transfer belt 30. Then, the recording material P is transported to the transfer portion of the first image forming portion Pa. At the same time, an image writing signal is turned on, and images are formed on the photosensitive drum 3*a* of the image forming portion Pa at a certain timing based on the image writing signal. A first color toner image formed on the photosensitive drum 3*a* is transferred to the recording materials P by being induced an electric field or electric charges thereon by the transfer charger 24*a* on the lower side of the photosensitive drum 3*a*.

By the transferring, the recording material P is tightly held on the transfer belt 30 by an electrostatic attractive force to be transported to the second image forming portion Pb. Without the electrostatic attraction of the recording material P to the transfer belt 30 at the same time of the transferring, the recording material P may be attracted by an attraction charger 5 disposed at a position on the upstream side of the first image forming portion Pa.

As the attraction charger 5, a noncontact charger such as a corona charger, or a contact charger using a charging member such as a blade, a roller and a brush is used.

As the transfer chargers 24 (24*a* to 24*d*), a noncontact charger such as a corona charger, or a contact charger using a charging member such as a blade, a roller and a brush is similarly used. The noncontact charger has problems such as a problem of the occurrence of ozone and a problem such that, because the noncontact charger performs the charging thereof through air, it has a weakness in that changes of temperature and humidity may result in images not being stably formed. On the other hand, the contact charger has merits such as a merit of not using ozone, a merit of being unaffected by changes of temperature and humidity, and a merit of being capable of realizing a high image quality.

There is a case where charge-eliminating needles 7*a*, 7*b*, 7*c* and 7*d* are provided for the stabilization of the transfer property of the chargers 24. Although the charge-eliminating needles 7*a* to 7*d* do not contact the transfer belt 30, the needles 7*a* to 7*d* discharge a part of transfer currents to escape them. It thereby becomes possible to prevent the disorder of toner images brought about by a separation electric-discharge when the photosensitive drums 3*a* to 3*d* and the recording materials P are separated.

The image formation and the image transformation of the second to the fourth image forming portions Pb–Pd are also performed similarly to those of the first image forming portion Pa. The charges of a recording material P on which four color toner images are superimposed and transferred in such a way is next eliminated by a separation charge-eliminator 32 at a downstream position of the transfer belt 30 in the transportation direction. Thereby, the electrostatic attractive force of the recording material P is decayed, and the recording material P is separated from the transfer belt 30 at one end side thereof. In particular, in low humidity circumstances, the recording material P becomes dried to make its electric resistance high. Then, the attractive force of the recording material P to the transfer belt 30 becomes high. Accordingly, the separation charge-eliminator 32 is needed for the separation of the recording material P from the transfer belt 30. Because the separation charge-eliminator 32 ordinarily charges the recording material P, on which toner images has not been fixed yet, to the polarity reverse to that of the attraction charging thereof, the noncontact charger is used as the separation charge-eliminator 32.

The separated recording material P is transported to the fixing device 9 with a guide member 64 and a transportation portion 62.

The fixing device 9 is composed of the fixing roller 51, a pressure roller 52, heat-proof cleaning members 54 and 55, heaters 56 and 57 installed in the rollers 51 and 52, the coating roller 50 for coating mold releasing oil such as dimethyl silicone oil, the oil reservoir 53 for reserving the oil, and a thermistor 58 for detecting the surface temperature of the pressure roller 52 to control a fixing temperature.

By the fixing processing of the recording material on which four color toner images are transferred, the colors of the toner images are mixed and the images are fixed on the recording material P. After thus formation of full color copy images, the recording material P is delivered to a delivery tray 63.

After the completion of transferring, the photosensitive drums 3*a*, 3*b*, 3*c* and 3*d* are cleaned to remove untransferred residual toner by respective cleaners 4*a*, 4*b*, 4*c* and 4*d* and are prepared for the formation of the next latent images. Toner and other smear remaining on the transfer belt 30 are removed with the cleaning blade 8*a* of the transfer belt cleaner 8, which blade 8*a* is made of polyurethane rubber and abuts on the transfer belt 30. The removed toner and the other smear are collected in the cleaner 8. After the cleaning, remaining charges on the surface of the transfer belt 30 are removed by charge-eliminating rollers 21 and 22, and then the transfer belt 30 is prepared for the next transfer process.

It is known that images are stabilized by the keeping of the current of the transfer chargers, which current contributes at the time of transferring to a suitable value. Accordingly, constant current control is ordinarily performed in order to obtain constant current even if volume resistivity is changed owing to the change of the kinds of recording materials (in thickness, quality of material, or the like), the change of moisture absorption and other changes.

A reference numeral 100 designates control means for performing the operation control of the color copying machine.

In one-side printing process, toner images are transferred to a recording material P transported from the recording material cassette 10 to be delivered to the delivery tray 63 immediately after being fixed. On the other hand, in the two-side printing process, the recording material P on which toner images have been fixed in the one-side printing process is not delivered, but is transported to a transporting path 67. The recording material P is switched back to be transported to a duplex transporting path 66, and then is transported to the transfer belt 30 again through the transporting path 65. The recording material P is placed on the transfer belt 30 such that the surface (first side) of the material P on which the toner images are fixed is touched to the transfer belt 30. After that, toner images are transferred on the back side (second side) of the material P similarly in the one-side printing process to be fixed, and then the material P is delivered.

Now, because the recording material P is touched with the fixing roller 51, on which mold releasing oil is coated, at the time of fixing, the mold releasing oil adheres to the front side of the recording material P. When the back side of the recording material P is printed, the front side of the recording material P, on which the mold releasing oil adheres, is placed on the transfer belt 30. Consequently, the mold releasing oil moves and adheres to the transfer belt 30.

When paper is used as the recording materials P, almost the entire mold releasing oil that adhered to white ground portions on the paper where no toner images are formed is absorbed into the paper and little amount of the oil is remaining on the surface of the paper. However, because as for the oil that adhered portions where toner images exist, only a part of the adhered oil absorbs into the paper, and almost the entire of the adhered oil remains on the surfaces of the toner images. The amount of the oil moved to the transfer belt 30 then becomes large. Consequently, there can been seen the following inclination: the larger the occupying area of toner images in the surface of the paper and the larger the densities of the toner images, the larger the adhesion amount of the oil to the transfer belt 30 becomes.

Figure 2:
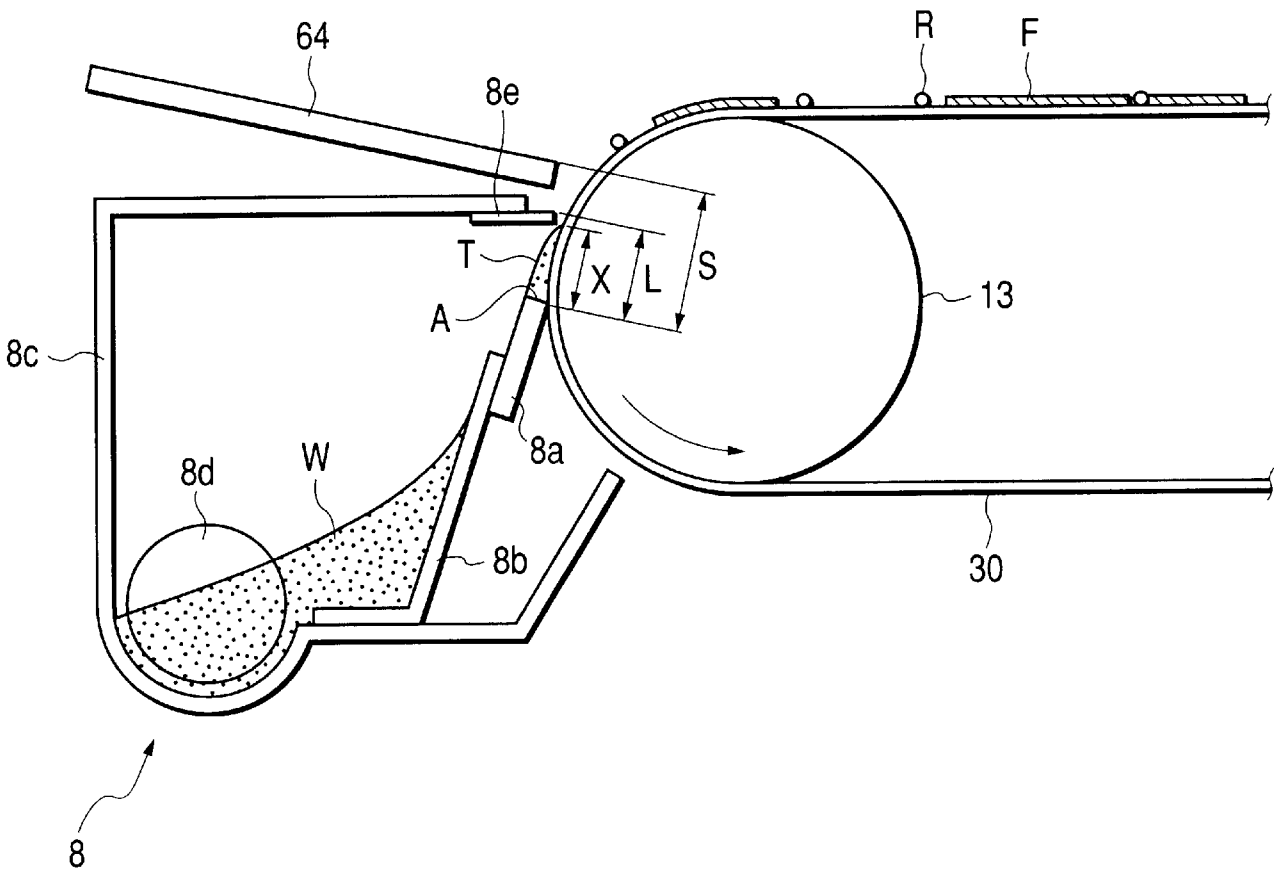
FIG. 2 is a cross section showing a cleaner of a transfer belt installed in the image forming apparatus of FIG. 1.

Next, the transfer belt cleaner 8 is described on the basis of FIG. 2.

The transfer belt cleaner 8 includes the cleaning blade 8*a*, as described above. As shown in FIG. 2, the cleaning blade 8*a* abuts on the surface of the transfer belt 30 at the portion thereof where the transfer belt 30 winds around the driving roller 13. More minutely, the cleaning blade 8*a* abuts on the surface of the transfer belt 30 at the position on the periphery of the belt 30 corresponding to, for example, at the position of the short hand indicating about nine o'clock. The abutting pressure of the blade 8*a* is 500 gf, and the angle formed by the tangential line at the point of contact and the blade 8*a* is about 10 degrees. The transfer belt cleaner 8 is equipped with a container 8*c*, and the cleaning blade 8*a* is provided to the cleaner 8 with adhering to and being fixed to a sheet metal 8*b* fixed in the container 8*c*.

The configuration such that the cleaning blade 8*a* abuts on the part where the transfer belt 30 winds around the driving roller 13 does not need to provide a member for exclusive use as a backup member at the blade abutting portion, and the configuration increases the pressing force of the transfer belt 30 to the driving roller 13 to make the transportation of the belt 30 more stable.

The fogging toner R on the transfer belt 30 is transported to the cleaning blade 8*a* by the rotation of the transfer belt 30. The transported fogging toner R is scraped off by the cleaning blade 8*a* to be collected into the container 8*c*. Hereupon, the fogging toner portion the toner that has transferred to the transfer belt 30 from non-image areas on the photosensitive drums 3 (3*a* to 3*d*) where the toner adhered when the photosensitive drums 3 directly contacted with the transfer belt 30 without any recording materials between them.

The toner collected into the container 8*c* moves along the inner wall of the container 8*c* as shown by a portion indicated by the letter W in FIG. 2. Then the collected toner is transported into a not shown collecting box by a carrying screw 8*d* installed in the container 8*c*. A shield plate 8*e* fixed at the end portion of the container 8*c* is provided in the upper portion of the cleaning blade 8*a*. The shield plate 8*e* prevents the toner scraped off with the cleaning blade 8*a* from scattering upwardly.

When two-side printing was continuously performed by the use of an image forming apparatus equipped with this transfer belt cleaner 8, an accumulation T of toner was generated on the blade edge face A of the cleaning blade 8*a* along the transfer belt 30 portion on the outer peripheral surface of the driving roller 3. When the height of the accumulation T became high, the accumulated toner overflowed from a gap between the driving roller 13 and the guide member 64. The overflown toner was separated from the transfer belt 30 to adhere to the lower surface of a recording material P passing through on the guide member. As a result, an image fault such that the recording materials P were dirtied occurred.

Examination of the causes of the accumulation of toner revealed the following mechanisms. Mold releasing oil F and the foggy toner R that adhered to the transfer belt 30 are cleaned by the cleaning blade 8*a*. The cleaned oil F and the toner R remain on the upper end portion of the cleaning blade 8*a* to mix with each other. The viscosity of the foggy toner R thereby increases. As a result the foggy toner R accumulates on the blade edge face A.

Figure 3:
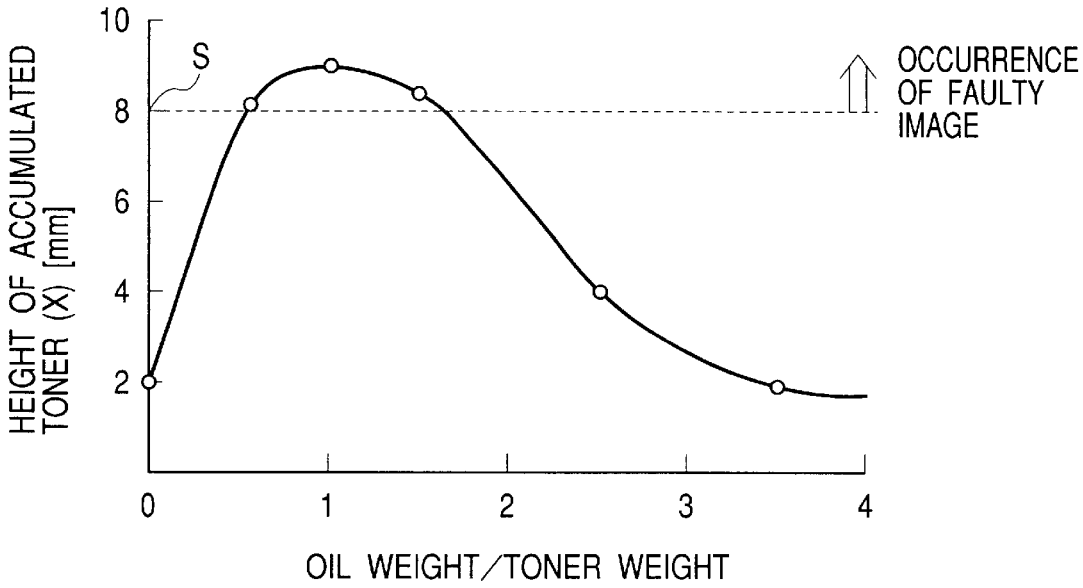
FIG. 3 is a graph showing a relation between the height of accumulated toner on the blade of the cleaner shown in FIG. 2 and oil mixing ratios of the toner.

FIG. 3 shows results of measurements of the height of the accumulation of the toner while changing the mixing ratios (weight ratios) of the mold releasing oil adhered to the recording materials P and the foggy toner R on the transfer belt 30. Hereupon, the "height of the accumulation of the toner" is a distance X shown in FIG. 2, i.e. a distance from the upper end of the cleaning blade 8*a*, on which the toner accumulated, to the upper end of the accumulation T, which touches to the transfer belt 30, of the toner.

As is apparent from FIG. 3, the height of the accumulation of the toner shows the maximum value of 8 mm or more when the ratio of the oil weight to the foggy toner weight is within a range of 0.5 to 1.5. When the ratio is smaller than the range or larger than the ratio, the height becomes low.

This reason is that, when the oil amount is very small such as the ratio is 0.5 or less, the toner into which the oil mixed remains in a form near to dried powder, and then the accumulation T of the toner collapsed on the cleaning blade 8*a* to fall into the container 8*c*. In particular, when only one-sided printing was performed, because the amount of oil that adheres to the transfer belt 30 was zero, the height of the accumulation T became low to be 2 mm. Moreover, when the oil is contained in large quantities such as the weight ratio is 1.5 or more, the toner in which the oil is mixed becomes a fluid state. And then, the toner flows down from the cleaning blade 8*a*.

In the present embodiment, the ordinary weight ratios of the oil amounts to the toner amounts, the oil and the toner being to be supplied on the cleaning blade 8*a*, was measured to be within a range of 0.5 to 1.5. Consequently, the height of the accumulation of the toner is large, 8 mm or more. The height exceeds the distance S, which is shown in FIG. 2 and is 8 mm, from the upper end of the cleaning blade 8*a* to the top surface of the guide member 64. Consequently, an image fault owing to the adhesion of toner occurs on the undersurface (first side) of the recording material P.

For preventing the occurrence of the faulty image, the accumulation height of the toner on the cleaning blade 8*a* should be lowered. For that, the amount of the oil to adhere to the transfer belt 30 should be decreased. Consequently, to decrease the amount of the oil to adhere to the recording materials P can be considered. However, when the amount of the oil to adhere to the recording material P by the decrease of the amount of oil to be coated on the fixing roller 51, large changes of the height of the accumulated toner could not be found. On the other hand, because the amount of oil to be coated is small, the releasability between the fixing roller 51 and the recording materials P decreases. Consequently, a new problem such that the recording materials P wound round the fixing roller 51 occurred.

The reason why the height of the accumulation of the toner did not change is that, even if the amount of the oil on the transfer belt 30 is decreased, the cleaning blade 8*a* always abuts against the belt 30 to stem the oil, and the oil accumulates on the cleaning blade 8*a* over time to mix with toner. Consequently, the method of decreasing the amount of the oil to be coated on the fixing roller 51 was not effective.

Accordingly, the following method was tried. That is, toner images were formed on the photosensitive drums 3 when toner accumulated on the cleaning blade edge face A to a degree of the height thereof at which the toner does not overflow from the belt cleaner 8. The formed toner images were transferred to the transfer belt 30 to form toner images on the transfer belt 30 directly. Then, the toner images are fed to the cleaning blade 8*a* to decrease the mixing ratio of the oil to the toner. As a result, it was ascertained that accumulated toner collapsed. The reason is that the oil reserved on the cleaning blade 8*a* was absorbed by the fed toner images to decrease the mixing ratio of the oil.

Furthermore, the following effects were also obtained. That is, by the feed of the toner images, the fed toner images invaded between the accumulation T of the toner on the cleaning blade 8*a* and the transfer belt 30. The accumulated toner T became easy to release. Moreover, the fed toner images pressed the accumulation T of the toner to drop it from the cleaning blade 8*a*.

Figure 4:
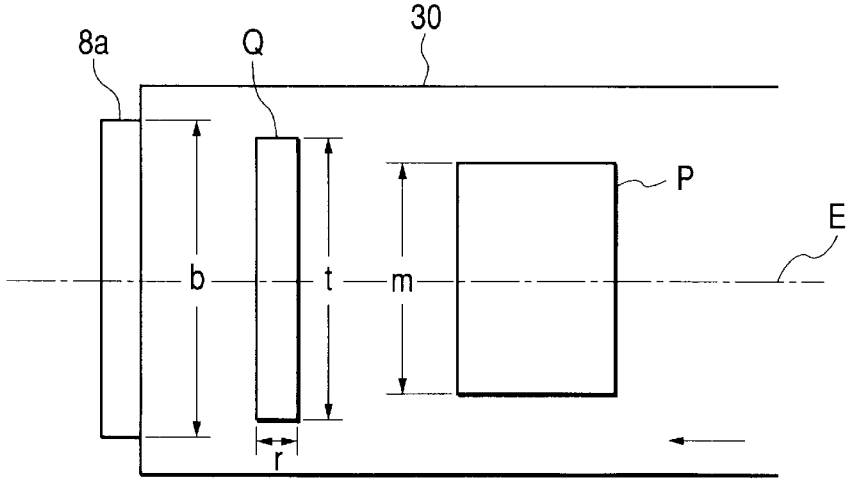
FIG. 4 is a mimetic diagram showing the relations in size between a pattern toner image formed on a transfer belt directly, the cleaning blade, a recording material and the like in the embodiment of FIG. 1.

FIG. 4 shows toner images to be directly formed on the transfer belt 30. A recording material P is transported while being absorbed about at the center of the transfer belt 30 in the direction perpendicular to the running direction of the transfer belt 30. A toner image Q generated by the direct image forming is a pattern in a rectangle having a width in the perpendicular direction of "t" and a width in the running direction of "r". The perpendicular direction width "t" is set to be a length meeting the formula of $m \leqq t \leqq b$, where "m" is the maximum width of the recording materials to be used and "b" is the width of the cleaning blade 8*a*. Moreover, the pattern toner image Q, the recording material P and the cleaning blade 8*a* are disposed to be severally axially symmetrical with respect to the central axis line E in the width direction of the transfer belt 30. The width, on which oil adheres, of the transfer belt 30 is the same as that of the recording material P. Consequently, the width where the oil is mixed on the cleaning blade 8*a* is substantially the same as that of the recording material m.

As described above, by the setting of the width t of the pattern toner image Q to be longer than the width m of the recording material P in order that the width direction of the pattern toner image Q covered the width direction of the recording material P, the oil mixing ratio of the accumulated toner on the cleaning blade 8*a* could uniformly be decreased independently from locations. Moreover, by the setting of the width t of the toner image Q to be shorter than the width b of the cleaning blade 8*a*, the pattern toner image Q on the transfer belt 30 was scraped off with the cleaning blade 8*a* over the whole length in the width direction. Consequently, uncleaned residual toner did not occur on the transfer belt 30.

Figure 5:
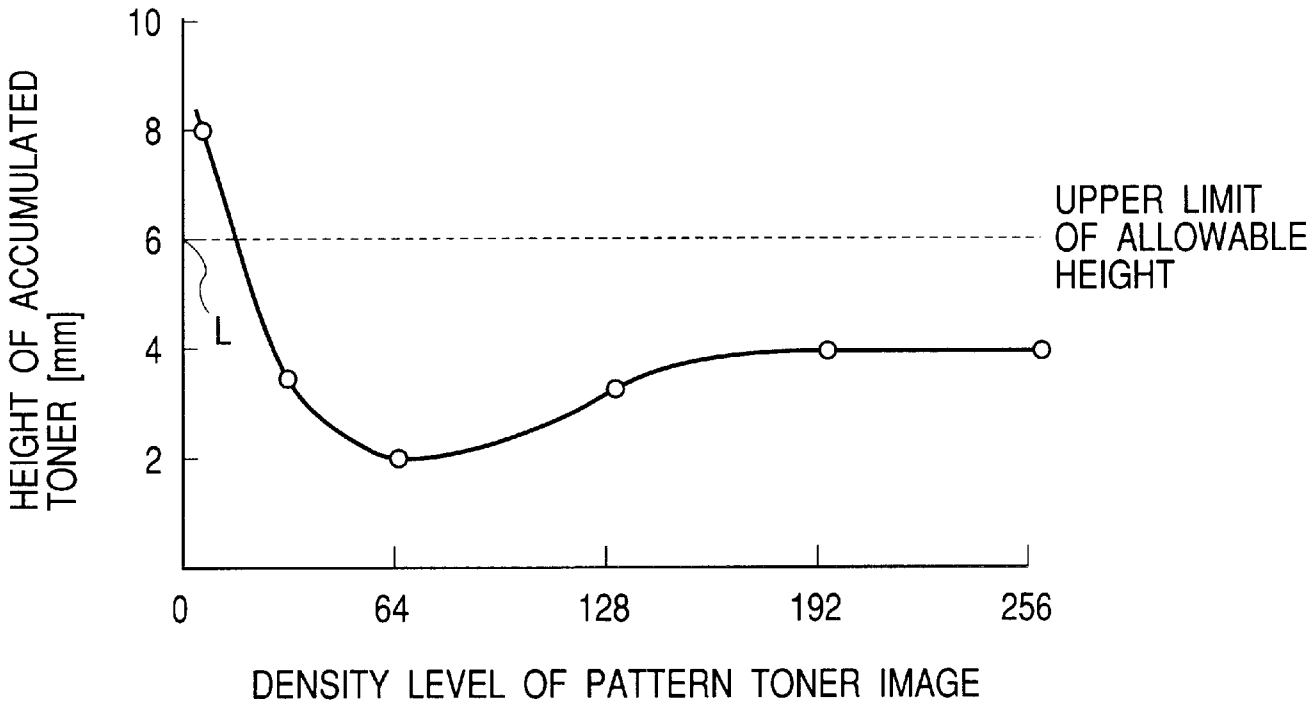
FIG. 5 is a graph showing a relation between the density of the pattern toner image of FIG. 4 and the height of accumulated toner.

As a result of examinations of the toner amounts of the pattern toner images Q, it was known that the optimum toner amount existed. The fact is described by reference to FIG. 5. FIG. 5 shows the results of the examinations of the height of accumulated toner vs. the changes of the density levels of the pattern toner images Q when the pattern toner images Q are fed at every predetermined sheets in a two-side printing process.

As the pattern toner images Q, solid images or medium tone images, both having uniform density independently of locations, were used. Because the total toner amount of the pattern toner images Q was preferably as little as possible, the total toner amount of the pattern toner images Q was kept to a constant amount of 1 mg/cm$^2$, and the widths r of the pattern toner images Q in the running direction of the transfer belt 30 were changed while the densities of the pattern toner images Q were changed. The widths t of the pattern toner images Q in the perpendicular direction were constant to be 300 mm. According to this case, as to the solid images, the total quantity of toner was 1 mg/cm$^2$, and the widths r were 12.5 mm, and the widths t were 300 mm. The density levels were changed from a 0-level to a 256-level. The 0-level corresponds to a blank image, and the 256-level corresponds to a solid image.

From FIG. 5, the following could be known. That is, when the density of a pattern toner image Q was too low, the effect of collapsing the accumulated toner could not be obtained. The height of the accumulated toner became minimum at a 64-level (r=50 mm) that was the density level of a medium tone image. When the density level was raised more than the medium tone level, the height of the accumulated toner gradually increased. The reason why the height of the accumulated toner increases on the high density side could be known as follows. That is, because the toner layers of the pattern toner images Q were thick, the toner at the upper part of the layers was not mixed with the accumulated toner on the blade edge face A sufficiently, and the toner at the upper part fell down in the cleaner container 8*c* with absorbing no oil. Consequently, the sufficient removal effect of the accumulated toner could not be obtained. Accordingly, to set the densities of the pattern toner images Q at the 64-level was effective for the object of decreasing the height of the accumulated toner and for the decrease of the consumption amount of toner in the present configuration.

Figure 6:
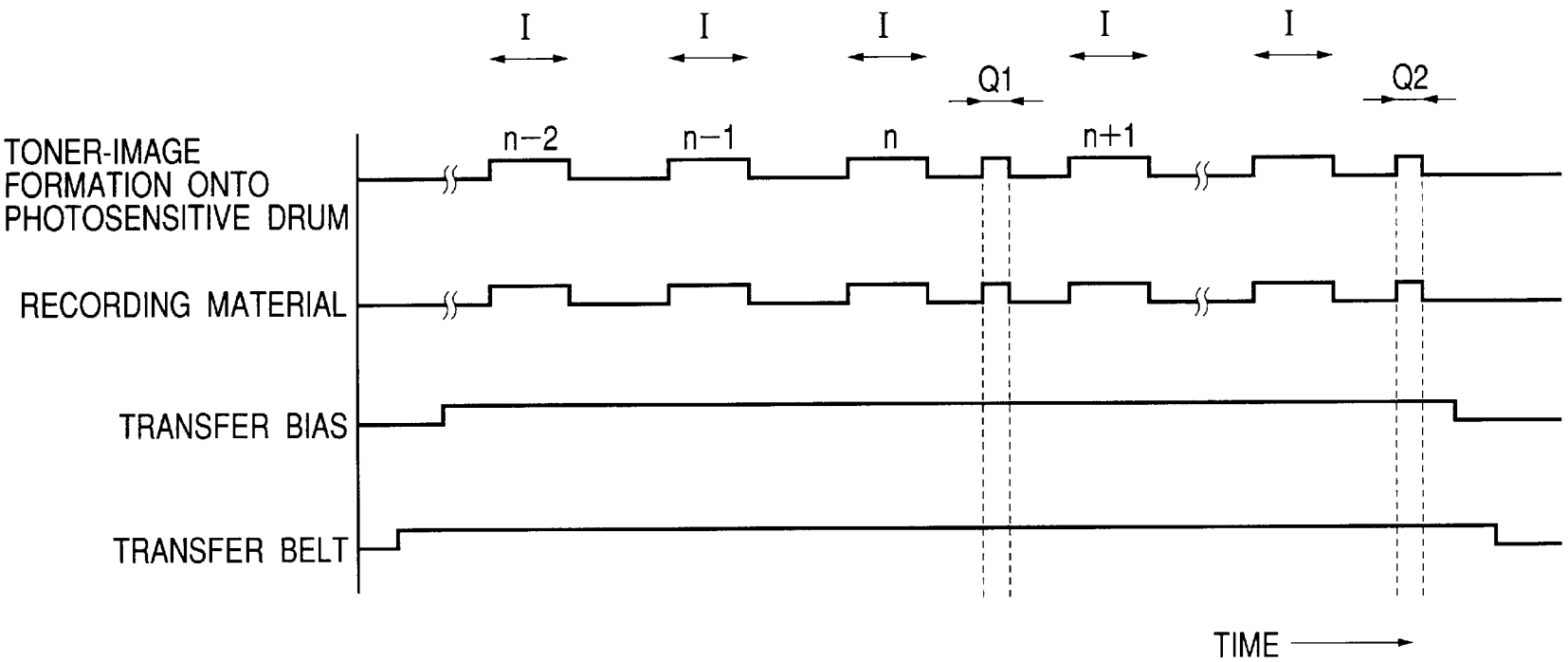
FIG. 6 is a timing chart showing the operation timings of the formation of the pattern toner image of FIG. 4.

FIG. 6 shows the operation timing at each portion for the formation of the pattern toner images Q on the transfer belt 30. The operation timings are viewed on the reference of the transferring position of an arbitrary transfer charger among the transfer chargers 24*a*, 24*b*, 24*c* and 24*d* of FIG. 1. Each region I indicates the timing when toner images to be recorded on a recording material P are continuously formed on the photosensitive drums 3*a*, 3*b*, 3*c* and 3*d* and then the toner images come to the transfer positions. The recording materials P are fed to the transfer positions by the transfer belt 30 in synchronization with each toner image. A transfer bias to be applied to the transfer chargers 24*a*, 24*b*, 24*c* and 24*d* is turned on at a short time before the recording materials P come to the transfer positions, the rotation of the transfer belt 30 is turned on in synchronization with the beginning of the rotation of the photosensitive drums 3*a*, 3*b*, 3*c* and 3*d* at a previous time of the application of the transfer bias.

A counter, a part of the components of the control means 100, counts the number of the recording materials P on which images have been formed. At every predetermined number of the recording materials P, a pattern toner image Q for feeding toner to the transfer belt cleaner 8 is formed. When the number of the recording materials P on which images have been formed reach "n", a pattern toner image Q1 is formed on the n$^{th}$ transfer belt 30 between the toner images on the n recording material P and on the (n+1)$^{th}$ recording material P. The formation of the pattern toner image Q1 on the transfer belt 30 is performed like the ordinal formation of toner images as follows. That is, after a pattern toner image was formed through the processes of charging, exposure and developing, a transfer bias is applied at the timing when there is no recording material P at the transfer position to form the pattern toner image Q1 on the transfer belt 30 directly.

The counter is reset to be zero when the pattern toner images Q have been formed. After that, the counter again begins to count the number of the recording materials P on which images have been formed to be reset at the formation of the pattern toner images Q of the next time. And then, the same operation is repeated. As another timing of the formation of the pattern toner image on the transfer belt 30, the timing may not be at intermediate timing between jobs (each of the jobs is the image-formation of a plurality of recording materials P as a series), but may be set at a time (Q2 in FIG. 6) immediately before the ending of the job that has reached the number of the recording materials P of "n" while the transfer belt 30 is rotating. Or, the timing may be set at a time immediately before the beginning of image-formation of the next job of the job that has reached the number of the recording materials P of "n" while the transfer belt 30 is rotating.

Figure 7:
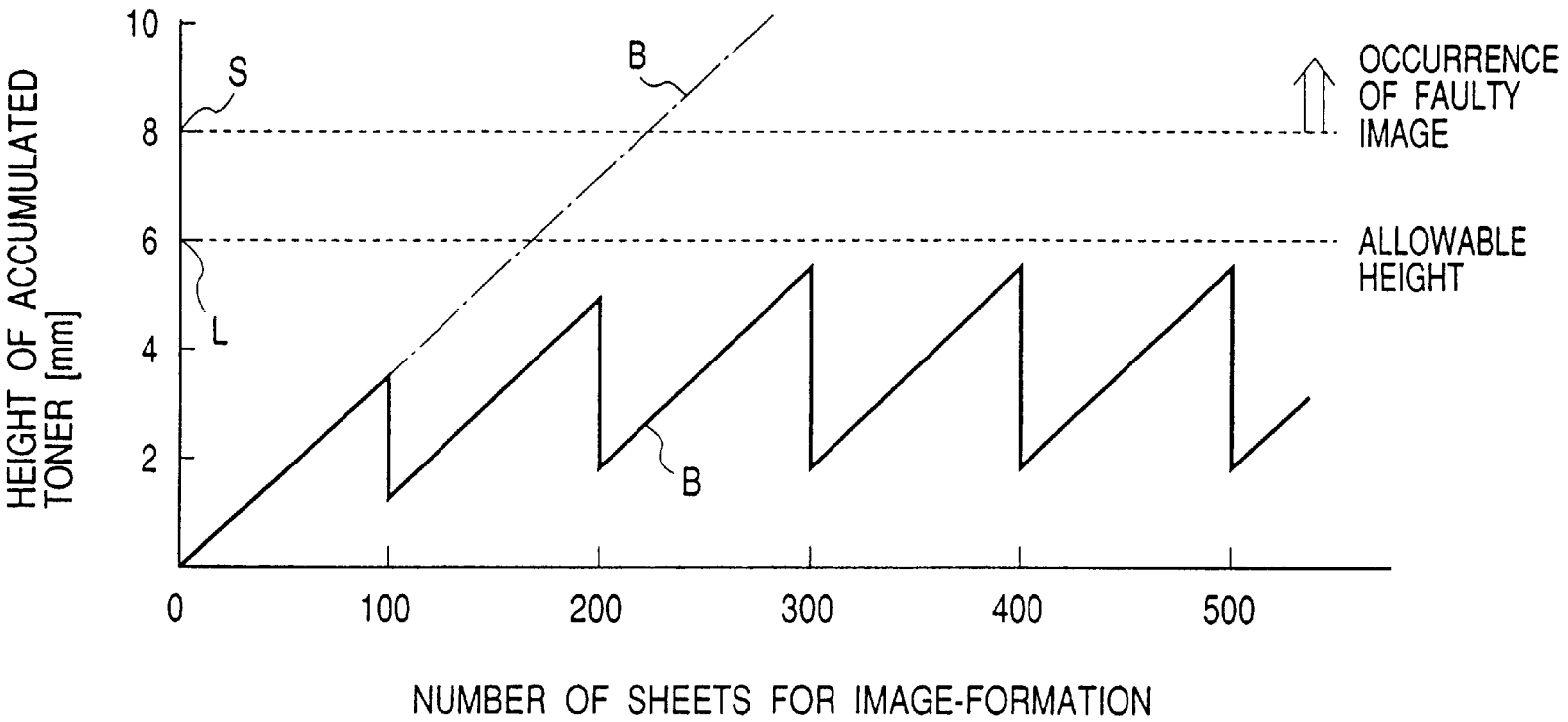
FIG. 7 is a graph showing a transition of the height of accumulated toner vs. the number of sheets on which images are formed.

In the apparatus described above, a transition of the height of the accumulated toner on the cleaning blade 8*a* when two-side printing processes are continuously performed is shown in FIG. 7. An alternate long and short dash line B in FIG. 7 shows a case of the related art, namely the case where no direct image-formation of a pattern toner image to the transfer belt is formed. In the case, the height of accumulated toner increases with the increase of the number of recording materials on which images have been formed. In the case, when the number of the recording materials reached to 200, the height of the accumulated toner exceeded the threshold value of 8 mm and faulty images occurred.

On the contrary, a zigzag continuous line B shows a case of the present embodiment, in which the direct image-formation of a pattern toner image to the transfer belt 30 is performed at every 100 times of image-formation (every 50 recording materials P in a two-side printing process). In the case, the height of accumulated toner increased up to a time immediately before the insertion of the operation of the direct image-formation of a pattern toner image to the transfer belt 30, but the height decreased immediately after the insertion. Consequently, the height is suppressed to an allowable height L or below, and no faulty image occurred. Hereupon, the allowable height L is a distance, shown in FIG. 2, from the upper end of the cleaning blade 8*a* to the shield plate 8*e*. The allowable height L is set to a value leaving a margin to the threshold value S, which is 8 mm.

Embodiment 2

Figure 8:
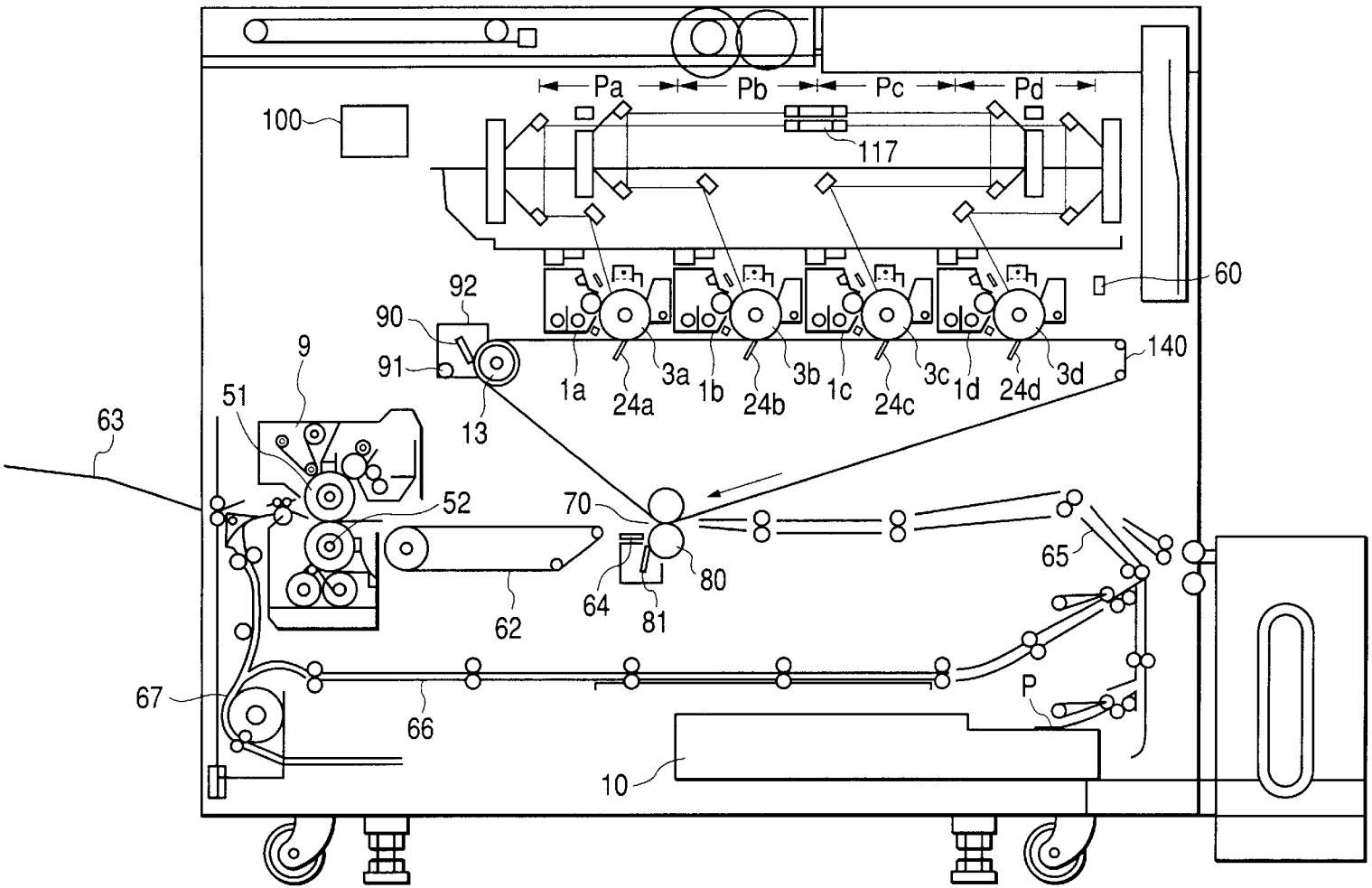
FIG. 8 is a schematic diagram showing the whole configuration of another embodiment of an image forming apparatus of the present invention.

FIG. 8 is a schematic diagram showing the whole configuration of another embodiment of an image forming apparatus of the present invention.

Although an example of the application of the invention to an image forming apparatus using a transfer belt is described in the first embodiment. The invention can also apply to an image forming apparatus using an intermediate transfer member as shown in FIG. 8. In FIG. 8, the members having the same functions as those of the apparatus shown in FIG. 1 are designated by the same reference marks as those in FIG. 1, and the description about them is omitted.

In the present embodiment, the image forming apparatus includes an intermediate transfer member in a shape of a belt, or an intermediate transfer belt 140. The intermediate transfer belt 140 is formed to be an endless belt body made from a polyimide resin and runs in the arrow direction in FIG. 8. Each color toner image formed on each photosensitive drum 3 (3*a* to 3*d*) is sequentially transferred to be superimposed on each other (a first transfer) on the intermediate transfer belt 140 by the transfer chargers 24 (24*a*, 24*b*, 24*c*, 24*d*) at respective first transferring positions. Then, the color toner images are carried to a second transfer position 70 with the rotation of the intermediate transfer belt 140. A recording material P is transported to the second transferring position from recording material cassette 10 at the same timing as that of the movement of the toner images on the intermediate transfer belt 140. A transfer bias is applied to a transfer charger 80 at the same time as the toner images touch the recording materials P to transfer the tone images to the recording materials P. As the second transfer charger 80, a transfer roller made of electrically conductive or semiconductive rubber was used.

The reference numeral 100 is control means for controlling the operation of the image forming apparatus.

The recording materials P on which the toner images were transferred are transported to the fixing device 9 that in turn fixes the toner images. In case of a two-side printing process, a recording material P one side, or the first side (front side), of which toner images were fixed are again transported to the second transfer position 70 through the transporting paths 67 and 66. Then, tone images are transferred on the second side (back side) to be fixed by the fixing device 9.

Because the transfer roller 80 being the second transfer means abuts on the first side of the recording materials P, on which mold releasing oil adhered, the mold releasing oil adheres to the transfer roller 80 from the recording materials P. Moreover, because the transfer roller 80 abuts on the intermediate transfer belt 140, fogging toner on the intermediate transfer belt 140 adheres to the transfer roller 80. For removing the oil and the fogging toner that adhered to the transfer roller 80, a cleaning blade 81 is abutted on the transfer roller 80.

In the cleaning blade 81, the oil and the fogging toner are mixed to generate excessive accumulation of toner. The accumulated toner overflowed from the cleaner. Then toner faults on the recording materials P occurred.

Accordingly, in the present embodiment, a pattern toner image was formed on the intermediate transfer belt 140 at every predetermined number of the recording materials P. The pattern toner image was not secondarily transferred on the recording materials P, but was transferred to the transfer roller 80 to be fed to the cleaning blade edge portion. Thereby, the height of the accumulated toner was lowered, and the faulty images could be prevented.

On the other hand, a cleaning blade 90 is abutted on the intermediate transfer belt 140 for removing untransferred residual toner of the second transferring, which residual toner is remaining on the intermediate transfer belt 140. Because the intermediate transfer belt 140 abuts on the transfer roller 80, a part of the oil that slipped through the cleaning blade 81 moves to the intermediate transfer belt 140 to be transported to the cleaning blade 90.

Consequently, at the cleaning blade 90, oil and toner were mixed with each other, and flocculation of toner occurred in the vicinity of the edge of the cleaning blade 90. However, because the cleaning blade 90 abutted against the intermediate belt 140 with its edge facing downward in the gravity direction, a part of the accumulated toner fell downward into a waste toner container 92 of the blade 90. Consequently, the height of the accumulated toner was low. However, the viscosity of the toner collected in the container 92 was high by absorbing the oil. Consequently, a problem such that the collected toner was not be delivered by adhering to a delivery screw 91 was generated.

Accordingly, in the present embodiment, a pattern toner image was directly formed on the intermediate transfer belt 140 at every predetermined number of recording materials P, and the toner image was not secondarily transferred on the recording materials P, but was fed to the cleaning blade 90 to be contained in the container 92. Thereby, the viscosity of the collected toner including oil in the container 92 was lowered by the toner of the toner image. Consequently, the collected toner can be transported by the delivery screw 91 fluently.

In this case, for preventing the secondary transfer of the pattern toner image on the intermediate transfer belt 140, the following measures may be adopted. That is, the secondary transfer bias is turned off during the pattern toner image is passing through the secondary transfer position. Or, the second transfer roller 80 is alienated from the intermediate transfer belt 140 during the pattern toner image is passing through the secondary transfer position.

Embodiment 3

Figure 13:
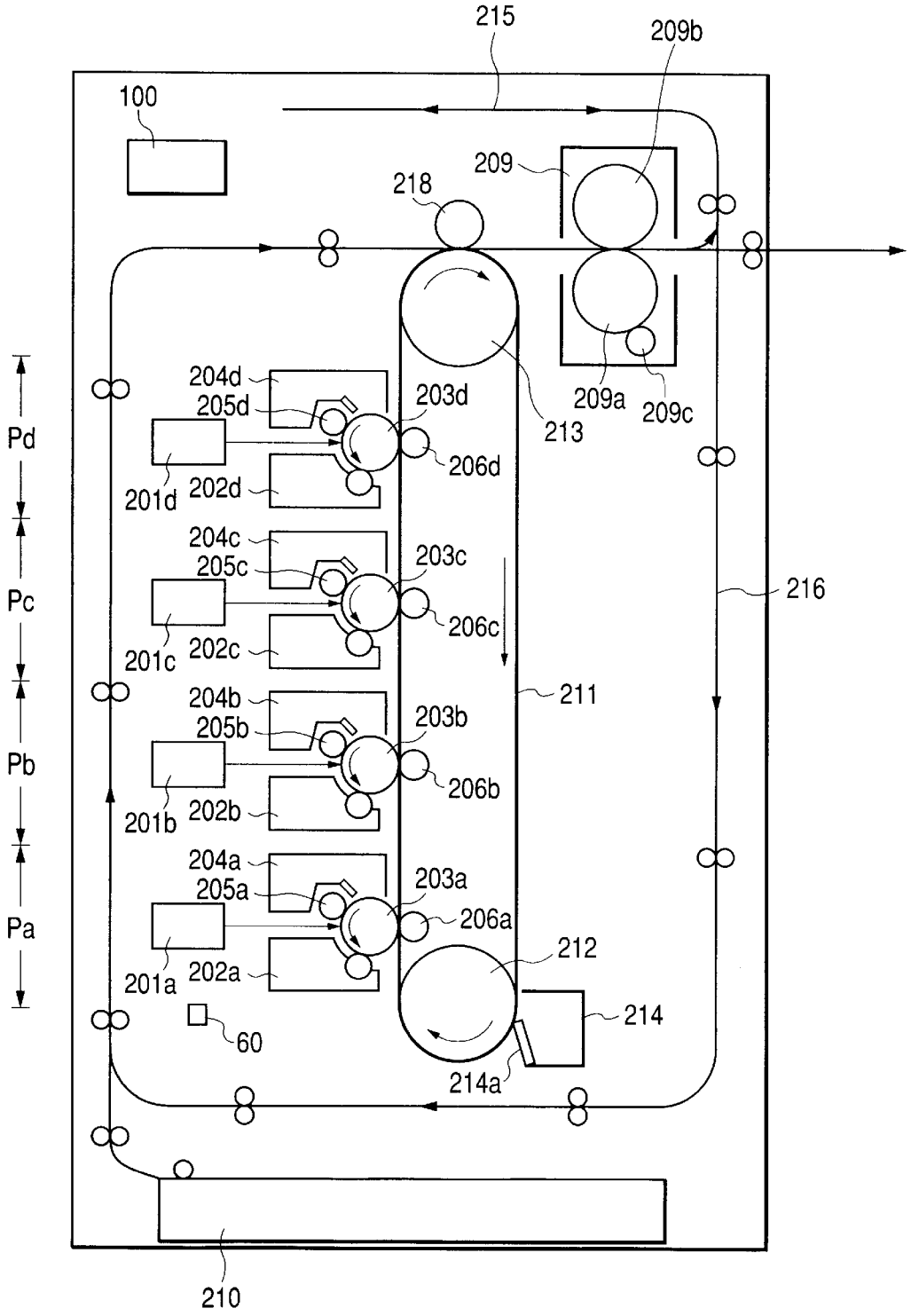
FIG. 13 is a schematic diagram showing the whole configuration of a further embodiment of an image forming apparatus of the present invention.

FIG. 13 is a schematic diagram showing another configuration of an image forming apparatus using an intermediate transfer member. The invention can also apply to a configuration equipped with a cleaning blade abutting against the transfer belt in the present embodiment.

A transfer belt 211 being an intermediate transfer member is stretched around rollers 213 and 212 to be transported in the arrow direction in FIG. 13. In the present embodiment, the roller 212 is a driving roller. On the side face of the transfer belt 211, image forming portions Pa–Pd capable of forming image in different colors are disposed. In the image forming portion Pa, a developing device 202*a*, a cleaning device 204*a* and a charging device 205*a* are disposed around a photosensitive drum 203*a* being an image bearing member. A latent image is formed by the exposure of the surface of the photosensitive drum 203*a* charged by the charging device 205*a* uniformly with exposure means 201*a*, and the latent image is developed with toner by the developing device 202*a*. The developed image is transferred on the transfer belt 211 by a transfer roller 206*a* being a first transfer means. The image forming portions Pb–Pd also have the same configuration.

Images formed by the image forming portions Pa–Pd severally are sequentially transferred on the transfer belt 211 in a manner of being superimposed to form a color image.

A recording material feed from a cassette 210 are transported to the secondary transfer portion formed between a roller 213 and a secondary transfer roller 218, and an image on the transfer belt 211 is transferred on the transported recording material. The recording material on which the image has been transferred is fixed by fixing means 209 equipped with a fixing roller 209*a* and a pressure roller 209*b*. At the fixing roller 209*a*, an oil coating member 209*c* for coating oil being a mold releasing member is disposed. The reference numeral 100 designates control means for controlling the operation of the present image forming apparatus.

In case of a two-side printing process, a fixed recording material is once guided to a surface reverse path 215, and then the recording material joins a feed path through a re-feed path 216 to be guided to the secondary transfer portion again.

In the present embodiment, a cleaning blade 214*a* included in a cleaning device 214 abuts on a portion where the transfer belt 211 is stretched over the driving roller 212 for performing the cleaning of untransferred toner and the like. In the embodiment also, because the cleaning blade 214*a* is disposed such that the blade edge face thereof faces toward upward, toner is easily reserved on the edge portion in the configuration. Consequently, there is a case where excessive toner accumulation on the blade edge portion occurs owing to the feed of oil to the blade edge portion. Accordingly, for the prevention of the problem, for example, a pattern toner image was formed on the transfer belt 211 at every predetermined number of the recording materials, and the pattern toner image was not secondarily recorded on the recording materials to be fed to the cleaning blade 214*a*. Thereby, the viscosity of the toner that includes the oil and was reserved on the edge portion was lowered by the fed toner of the pattern toner image. Thereby, excessive toner accumulation on the blade edge portion could be prevented, and the overflow of toner could be prevented.

Embodiment 4

In the present embodiment, a method for decreasing the feed amount of pattern toner images is described. It is preferable to decrease the feed amount from the point of view for the suppression of the consumption amount of toner. It also has an advantage such that the running cost of toner can be reduced.

In the image forming apparatus shown in FIG. 1, the increase of the height of accumulated toner on the cleaning blade 8*a* is especially large at the time of the two-side printing process in which oil is always fed to the cleaning blade 8*a*. On the contrary, at the time of the one-side printing process after the completion of the two-side printing process, the oil feeding to the transfer belt 30 does not occur, and the oil on the transfer belt 30 is absorbed by the pattern toner images to be removed and collected by the cleaning blade 8*a* together with the pattern toner images. Consequently, the mixing ratio of the oil gradually decreases, and the height of the accumulated toner gradually decreases also.

Figure 9:
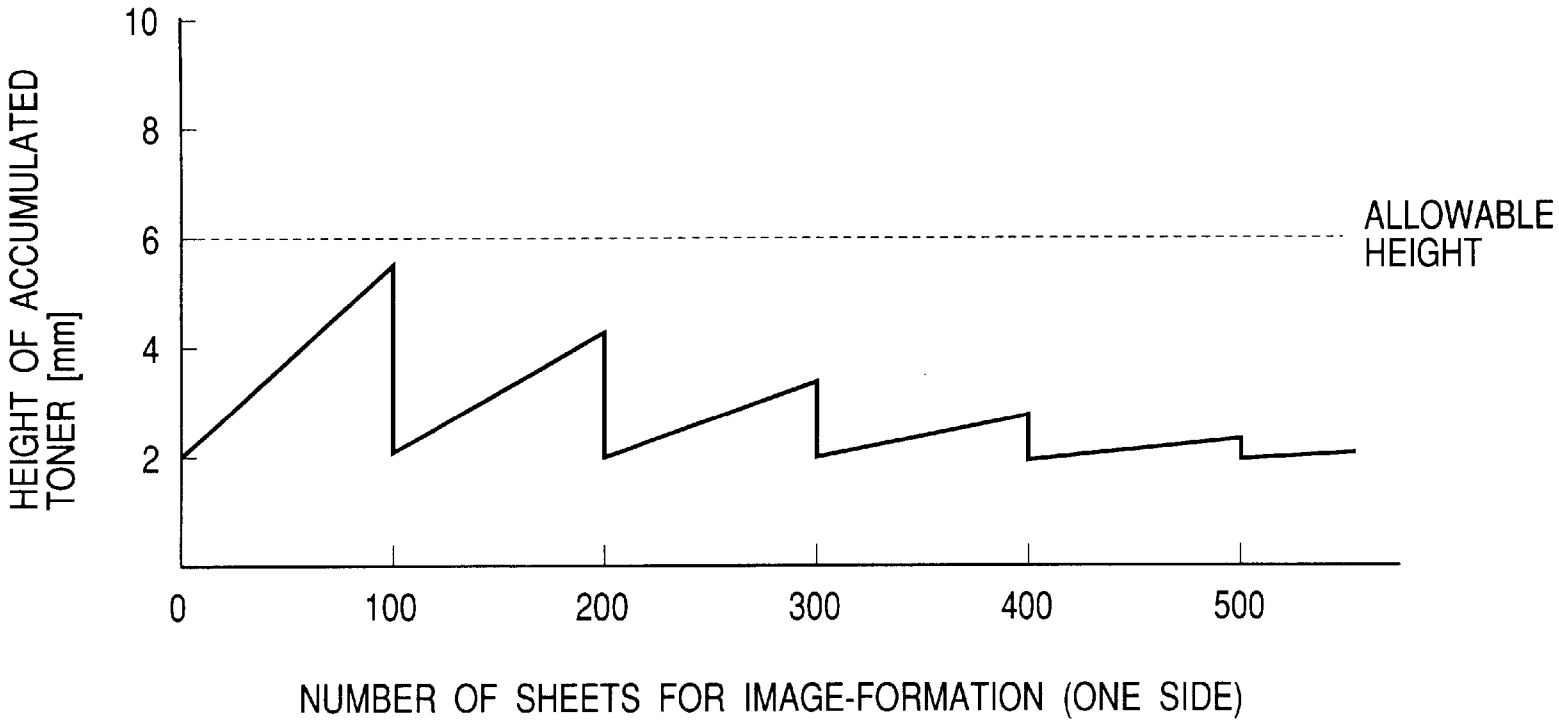
FIG. 9 is a graph showing a transition of the height of accumulated toner vs. the number of sheets only on one side of which images are formed.

FIG. 9 shows a transition of the height of the accumulated toner at the time of the one-side printing process in which the two-side printing of a sufficient number of recording materials is performed while pattern toner images are fed and then one-side printing is continuously performed after the last pattern toner image has been fed. The time interval of the feeding of the pattern toner images was set to be 100 recording materials P similarly in Embodiment 1.

As shown in FIG. 9, the height of the accumulated toner gradually lowered to be finally about a constant value (the same 2 mm as the height of the accumulated toner in the case where no oil existed on the transfer belt 30). As known from the result, because the gradient of rise becomes small in case of one-side printing process, the time interval of the feeding can be set longer than that in case of two-side printing process. Moreover, because the height of accumulated toner becomes lowered, it is possible to extend the time interval of the feeding to stop the feeding finally.

Figure 10:
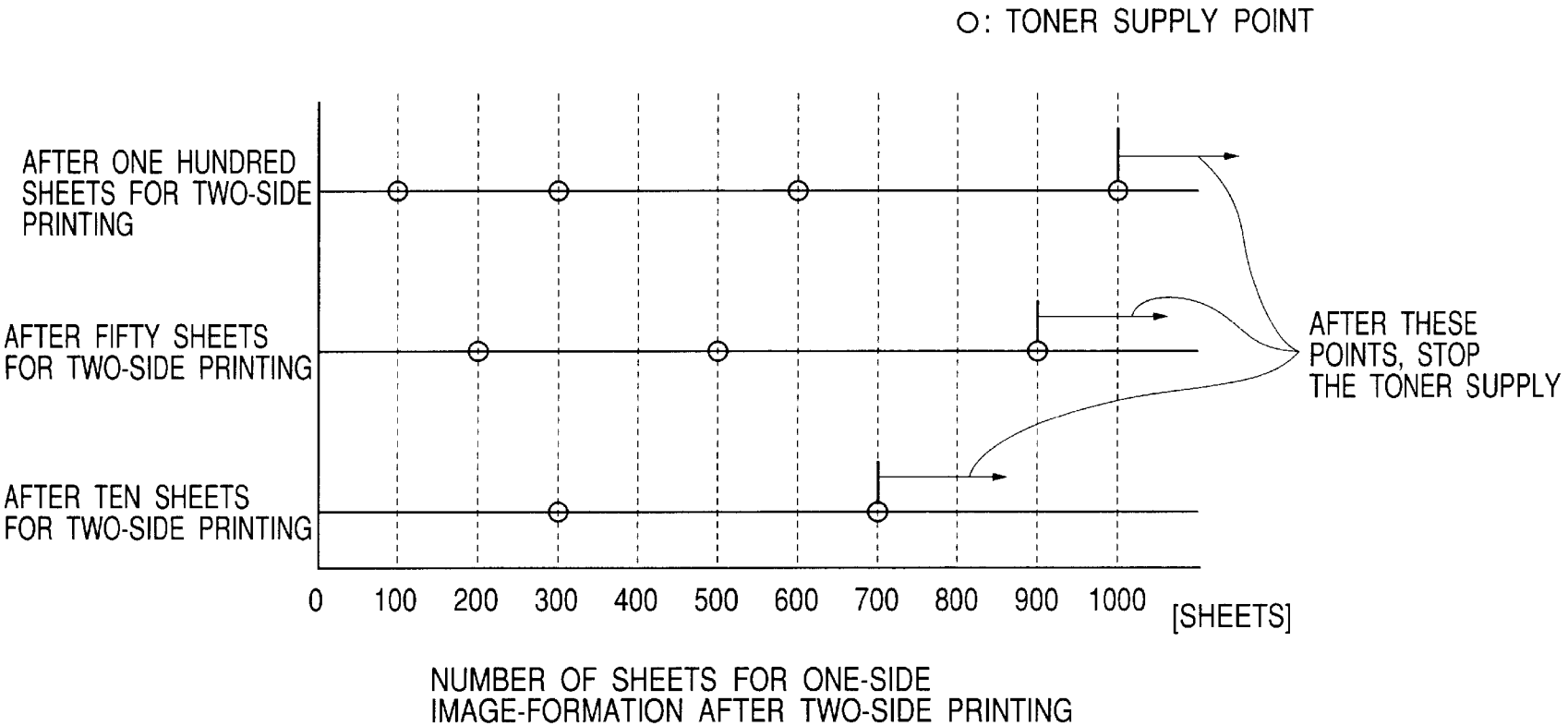
FIG. 10 is a graph showing changes of toner supplying intervals at the time of a one-side printing after a two-side printing.

FIG. 10 shows a method for setting the time interval of feeding toner in case of one-side printing process after performing a predetermined number of two-side printing processes of recording materials P.

Time points of toner feeding at one-side printing after the performance of the two-side printing of 100 recording materials P are a 100-recording material point, a 300-recording material point, a 600-recording material point and a 1,000-recording material point. The larger the numbers of one-side printing of recording materials P become, the wider the time intervals of feeding toner gradually become. That is, the substantial feed amounts of toner become smaller and smaller. At a point of time of 100 recording materials P immediately after the beginning of one-side printing, because many times of two-side printing has performed before that time and the amount of accumulated oil at the cleaning blade edge 8*a* portion is still large, toner is fed after one-side printing of 100 recording materials P like in case of two-side printing. Because one-side printing is repeated after that and an oil is not fed, the accumulation of toner is reduced. And then, the time interval of feeding toner can be widened. Furthermore, as the number of one-side printing of the recording materials P increases, the accumulation of toner is also reduced more and more. Consequently, the time interval of feeding toner can further be widened. After toner was fed at the point of time of 1,000 one-side printing of recording materials P when the time interval of feeding toner becomes 400 recording materials P, the height of accumulated toner on the blade edge 8*a* portion does not become a level to produce a problem any longer. Accordingly, it becomes unnecessary to feed toner after that.

Moreover, the less the number of two-side printing of recording materials P is before one-side printing, the more the amount of the accumulated oil at the cleaning blade edge 8*a* portion decreases. Consequently, as the following examples show, the time interval for feeding toner can also be widened accordingly.

Time points of toner feeding at one-side printing after the performance of the two-side printing of 50 recording materials P are a 200-recording material point, a 500-recording material point and a 900-recording material point, and toner is not fed after the 900-recording material point.

Moreover, time points of toner feeding at one-side printing after the performance of the two-side printing of 10 recording materials P are a 300-recording material point and a 700-recording material point, and toner is not fed after the 700-recording material point.

In the examples described above, the time intervals for feeding toner are set to be longer as a method for decreasing the feed amount. Besides, for example, the amount of toner fed at one feeding may be decreased according to the number of one-side printing of recording materials P while the time interval of feed is fixed to the interval for the printing of 100 recording materials P similarly in the two-side printing process.

FIG. 11 shows a method for setting the feed amounts of toner at the time of the one-side printing process after a predetermined number of two-side printing of recording materials P.

When toner is fed at every 100-recording material in the one-side printing process after the performance of the two-side printing of 100 recording materials P, the density levels of pattern toner images are gradually decreased from the 64-level shown in the previous embodiment as the increase of the number of the printing of the recording materials P. Then, after the feeding of toner at the density level of 16-level at the point of time of 600-recording material, toner is not fed.

After the performance of the two-side printing of 50 recording materials P, the one-side printing process is begun at the density level of 56-level. After toner is fed at the density level of 16-level when 500 recording materials P have been printed, toner is not fed.

After the performance of the two-side printing of 10 recording materials P, the one-side printing process is begun at the density level of 48-level. After toner is fed at the density level of 6-level when 400 recording materials P have been printed, toner is not fed.

In such a way, the smaller the number of two-side printing of the recording materials P before a one-side printing process is, the smaller the amount of accumulated toner at the blade edge 8*a* portion becomes. Consequently, the feed amount of toner at every 100-recording material and the total feed amount of toner can be small.

Incidentally, the image forming apparatus having the configuration of FIG. 1 is described in the present embodiment, but similar advantages can be obtained in the cases where the present embodiment is applied to the configurations of FIGS. 8 and 13.

Embodiment 5

Another method for decreasing the feed amount of toner of pattern toner images is described in the present embodiment.

It has been described that the heights of accumulated toner depend on the amounts of the oil adhered to the transfer belt 30. In addition to that, it was known that the oil amounts changed in accordance with humidity. That is, the lower the humidity is, the more the low molecular weight components of dimethyl silicone oil used as mold releasing oil vaporize. The increase of the vaporization decreases the amounts of oil on the transfer belt 30 and the cleaning blade 8*a*. As a result, it was known that, even if the two-side printing of the same number of the recording materials P was performed, the height of accumulated toner did not become so high in low humidity circumstances as in high humidity circumstances. It is possible to decrease the toner amount of pattern toner images at low humidity circumstances by utilizing the phenomenon.

Figure 12:
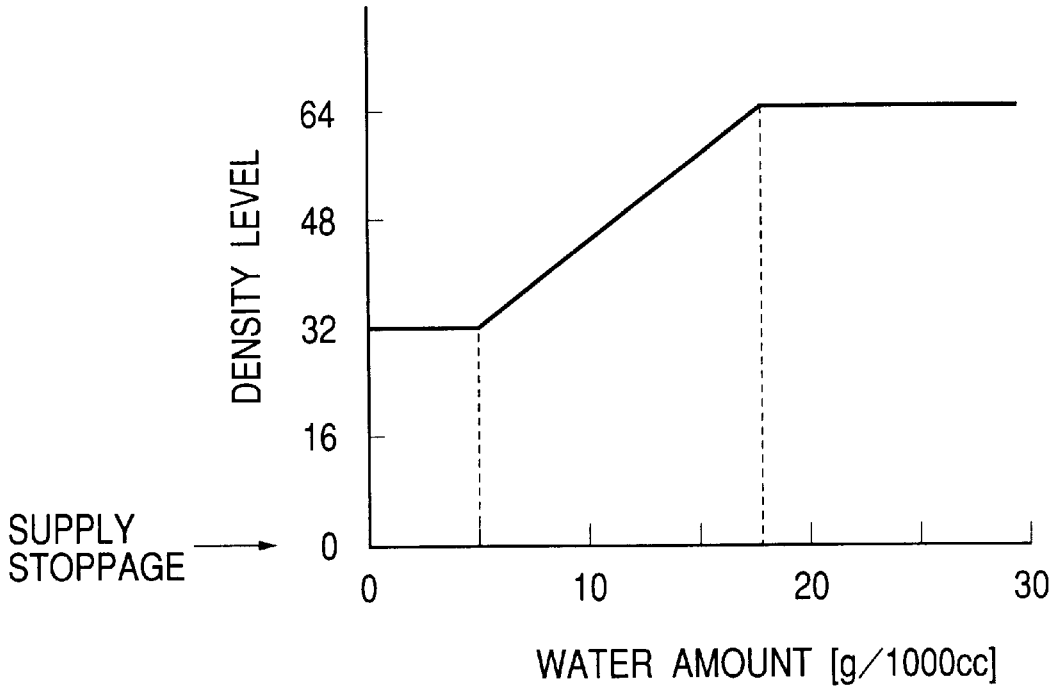
FIG. 12 is a graph showing a density setting method of a pattern toner image vs. water amounts.

FIG. 12 shows a setting in a two-side printing process of the density levels of pattern toner images vs. water amounts (absolute water amounts, or the weights of water included in the volume of 1,000 cc of air) in the atmosphere in the image forming apparatus.

In high humidity circumstances such that the water amounts are 18 g or more, the pattern toner images Q having the same density as that of Embodiment 1 (64-level) are necessary for suppressing the height of accumulated toner. On the other hand, in low humidity circumstances such that the water amounts were 5 g or less, the height of accumulated toner could be suppressed even if the density level was a half (32-level) of that in the high humidity circumstances. In the intermediate humidity circumstances between the density levels of 5 g and 18 g, a setting in which the density levels are linearly interpolated achieved effects.

In the present embodiment, as means for detecting the water amounts in the apparatus, an environmental sensor 60 for detecting temperatures and relative humidity is disposed in the vicinity of the transfer belt 30 of the image forming apparatus in FIG. 1. The water amounts are calculated on the basis of the temperatures and the relative humidity that were detected by the environmental sensor 60. In the present embodiment, the density levels are set to be switched according to the calculated water amounts on the basis of the data shown in FIG. 12.

Thereby, the height of accumulated toner could be lowered and the minimum consumption amounts of toner could be kept according to the changes of the water amount in the circumstances in the image forming apparatus.

Although an example of changing the density level of feed toner according to the detected water amount is described in the above description, the same effects can be obtained by a method of changing the time intervals of feeding toner according to the detected water amounts. That is, a control of widening the time intervals of feeding toner as the detected water amounts become smaller can be performed.

For example, because toner is easy to accumulate when the water amount is 18 g or more, toner is fed every 100 recording materials P. When the water amount is 5 g or less, toner is fed every 200 recording materials P. When the water amount is between 5 g and 18 g, the time intervals of feeding toner is set on the basis of linear interpolation.

Incidentally, the concrete numeral values of the time intervals of feeding toner, the density levels of feed toner, the detected water amounts, and like that are shown in the aforesaid embodiments are only examples. They are the most suitable values for respective configuration of the apparatus. The numeral values are not limited to the shown values.

Incidentally, the present embodiment can also be applied to any of the configurations of FIG. 1, FIG. 8 and FIG. 13, and in all cases similar advantages can be obtained.

As described above, according to the present invention, because toner images are directly formed periodically on a recording-material transporting member, an intermediate transfer member or a transfer member in an image forming apparatus capable of two-side printing, and then the toner is fed to the cleaning blade of the recording-material transporting member, the cleaning blade of the intermediate transfer member or the cleaning blade of the transfer member. Consequently, the accumulation of toner on those cleaning blades, which accumulation is caused by the movement of oil adhered to the recording materials at the time of fixing to the recording-material transporting member, the intermediate transfer member or the transfer member, can be prevented. Thereby, the occurrence of the problems such as the smearing in the machine, the back side smear of the recording materials, and the like can be prevented.

Although the invention has been described in its preferred form with a certain degree of particularity, obviously many changes and variations are possible therein. It is therefore to be understood that the present invention may be practiced than as specifically described herein without departing from scope and the sprit thereof.

What is claimed is:

1. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein, in a case in which image formation on a plurality of recording materials is performed as a series of operations, when a number of times of image formation reaches the predetermined number during the series of operations, the feeding operation is performed after termination of the series of operations.

2. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein the predetermined number is larger at a time of one-side image formation than that at a time of two-side image formation.

3. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording material transporting member in a moving direction of said recording-material transporting member, and said surface of the cleaning member facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein a time interval of feeding toner is enlarged by an increase of the predetermined number according to an increase of the number of times of one-side image formation on the recording material.

4. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein the predetermined number of times of one-side image formation on the recording material after two-side image formation is determined according to the number of times of said two-side image formation.

5. An image forming apparatus according to claim 4, wherein the predetermined number becomes smaller as the number of times of two-side image formation becomes larger.

6. An image forming apparatus according to claim 5, wherein a time interval of feeding toner is enlarged by an increase of the predetermined number according to an increase of the number of times of one-side image formation on the recording material.

7. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein a toner feed amount at one time of the feeding operation is decreased according to an increase of the number of times of one-side image formation on the recording material.

8. An image forming apparatus according to claim 7, wherein the toner feed amount is decreased by lowering a density of the supply toner image.

9. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction; and control means for controlling said apparatus so as to transfer a supply toner image, which is to be fed to said cleaning means, formed by said image forming means onto said recording-material transporting member directly, and to feed the supply toner image transferred onto said recording-material transporting member to said cleaning means by said recording-material transporting member, wherein a feeding operation of the supply toner image is performed at every predetermined number of times of image formation on the recording material, and wherein a toner feed amount at one time of the feeding operation at a time of one-side image formation on the recording material after two-side image formation is determined according to the number of times of said two-side image formation.

10. An image forming apparatus according to claim 9, wherein the toner feed amount is increased when the number of times of two-side image formation is larger.

11. An image forming apparatus according to claim 10, wherein the toner feed amount is decreased according to an increase of the number of times of one-sided image formation on the recording material.

12. An image forming apparatus comprising:

image forming means for forming a toner image;

a recording-material transporting member for bearing and transporting a recording material;

cleaning means equipped with a cleaning blade abutting against a surface of the recording-material transporting member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said recording-material transporting member in a moving direction of said recording-material transporting member, and said surface of the cleaning blade facing a direction substantially opposite the gravity direction;

control means for controlling said apparatus to transfer a supply toner image, which is to be fed to said cleaning means, formed by said image forming means onto said recording-material transporting member directly, and to feed the supply toner image transferred on said recording-material transporting member to said cleaning means by said recording-material transporting member, wherein a feeding operation of the supply toner image is performed at every predetermined number of times of image formation on the recording material; and humidity detection means for detecting humidity, wherein said apparatus determines the predetermined number according to a detection result of said humidity detection means, wherein the predetermined number is further decreased according to the detection result being higher.

13. An image forming apparatus according to any one of claims 1–12, wherein, a plurality of said image forming means are arranged along the transportation direction of said recording-material transporting member, and a toner image formed by each image forming means is successively transferred and superimposed on the recording material transported by said recording-material transporting member.

14. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material, and wherein, in a case in which image formation on a plurality of recording materials is performed as a series of operations, when a number of times of image formation reaches the predetermined number during the series of operations, the feeding operation is performed after a termination of the series of operations.

15. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material, and wherein the predetermined number is larger at a time of one-side image formation than that at a time of two-side image formation.

16. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material, and wherein a time interval of feeding toner is enlarged by an increase of the predetermined number according to an increase of the number of times of one-side image formation on the recording material.

17. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which as been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material; and wherein the predetermined number of times of one-side image formation on the recording material after two-side image formation is determined according to the number of times of said two-side image formation.

18. An image forming apparatus according to claim 17, wherein the predetermined number becomes smaller as the number of times of two-side image formation becomes larger.

19. An image forming apparatus according to claim 18, wherein a time interval of feeding toner is enlarged by an increase of the predetermined number according to an increase of the number of times of one-side image formation on the recording material.

20. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material, and wherein a toner feed amount at one time of the feeding operation is decreased according to an increase of the number of times of one-side image formation on the recording material.

21. An image forming apparatus according to claim 20, wherein the toner feed amount is decreased by lowering a density of the supply toner image.

22. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning bade against said intermediate transfer member in a moving direction of said intermediate transfer member, and said surface of the cleaning blade facing a direction substantially opposite the gravity direction; and control means for controlling said apparatus so as to bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material, and wherein a toner feed amount at one time of the feeding operation at a time of one-side image formation on the recording material after two-side image formation is determined according to the number of times of said two-side image formation.

23. An image forming apparatus according to claim 22, wherein the toner feed amount is increased when the number of times of two-side image formation is larger.

24. An image forming apparatus according to claim 23, wherein the toner feed amount is decreased according to an increase of the number of times of one-side image formation on the recording material.

25. An image forming apparatus comprising:

image forming means for forming a toner image;

an intermediate transfer member for bearing the toner image formed by said image forming means;

transfer means for transferring the toner image borne on said intermediate transfer member onto a recording material;

cleaning means equipped with a cleaning blade abutting against a surface of said intermediate transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said intermediate transfer member in a moving direction of said intermediate transfer member, and said surface of the cleaning blade facing a direction substantially opposite the gravity direction;

control means for controlling said apparatus so as bear a supply toner image, which is to be fed to said cleaning means, formed by said image forming means on said intermediate transfer member, and to feed the supply toner image borne by said intermediate transfer member to said cleaning means by said intermediate transfer member, wherein a feeding operation of the supply toner image is performed at every predetermined number of times of image formation on the recording material; and humidity detection means for detecting humidity, wherein said apparatus determines the predetermined number according to a detection result of said humidity detection means, wherein the predetermined number is further decreased according to the detection result being higher.

26. An image forming apparatus according to any one of claims 14–25, wherein, a plurality of said image forming means are arranged along the transportation direction of said intermediate transfer member, and a toner image formed by each image forming means is successively superimposed on said intermediate transfer member, and thereafter the superimposed toner image is transferred onto the recording material by said transfer means collectively.

27. An image forming apparatus comprising:

image forming means for forming a toner image;

a transfer member for transferring the toner image formed by said image forming means on a recording material;

cleaning means equipped with a cleaning blade abutting against a surface of said transfer member; and fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of times of image formation on the recording material, and wherein, in a case in which image formation of a plurality of recording materials is performed as a series of operations, when a number of times of image formation reaches the predetermined number during the series of operations, the feeding operation is performed after a termination of the series of operations.

28. An image forming apparatus comprising:

image forming means for forming a toner image;

a transfer member for transferring the toner image formed by said image forming means on a recording material;

cleaning means equipped with a cleaning blade abutting against a surface of said transfer member; and fixing means equipped with a fixing member on which a mold release agent is coated, wherein said apparatus can form an image on a surface of the recording material, a fixing operation of which has been performed by said fixing means, the surface of the recording material being opposite to a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of time of image formation on the recording material, and wherein the predetermined number is larger at a time of one-side image formation than that at a time of two-side image formation.

29. An image forming apparatus comprising:

image forming means for forming a toner image;

a transfer member for transferring the toner image formed by said image forming means on a recording material;

cleaning means equipped with a cleaning blade abutting against a surface of said transfer member; and fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of times of image formation on the recording material, and wherein a time interval of feeding toner is enlarged by an increase of the predetermined number according to an increase of the number of times of one-side image formation on the recording material.

30. An image forming apparatus comprising:

image forming means for forming a toner image;

a transfer member for transferring the toner image formed by said image forming means on a recording material;

cleaning means equipped with a cleaning blade abutting against a surface of said transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of times of image formation on the recording material, and wherein the predetermined number of times of one-side image formation on the recording material after two-side image formation is determined according to the number of times of said two-side image formation.

31. An image forming apparatus according to claim 30, wherein the predetermined number becomes smaller as the number of times of two-side image formation becomes larger.

32. An image forming apparatus according to claim 31, wherein a time interval of feeding toner is enlarged by an increase of the predetermined number according to an increase of the number of times of one-side image formation on the recording material.

33. An image forming apparatus comprising:

image forming means for forming a toner image;

a transfer member for transferring the toner image formed by said image forming means on a recording material;

cleaning means equipped with a cleaning blade abutting against a surface of said transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of times of image formation on the recording material, and wherein a toner feed amount at one time of the feeding operation is decreased according to an increase of the number of times of one-side image formation on the recording material.

34. An image forming apparatus according to claim 33, wherein the toner feed amount is decreased by lowering a density of the supply toner image.

35. An image forming apparatus comprising:

image forming means for forming a toner image;

a transfer member for transferring the toner image formed by said image forming means on a recording material;

cleaning means equipped with a cleaning blade abutting against a surface of said transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction; and control means for controlling said apparatus so as to transfer a supply toner image formed by said image forming means on said transfer member directly, and to feed the supply toner image to said cleaning means by said transfer member, wherein a feeding operation of the supply toner image is performed at every predetermined number of times of image formation on the recording material, and wherein a toner feed amount at one time of the feeding operation at a time of one-side image formation on the recording material after two-side image formation is determined according to the number of times of two-side image formation.

36. An image forming apparatus according to claim 35, wherein the toner feed amount is increased when the number of times of two-side image formation is larger.

37. An image forming apparatus according to claim 36, wherein the toner feed amount is decreased according to an increase of the number of times of one-side image formation on the recording material.

38. An image forming apparatus comprising:

image forming means for forming a toner image;

a transfer member for transferring the toner image formed by said image forming means on a recording material;

cleaning means equipped with a cleaning blade abutting against a surface of said transfer member;

fixing means equipped with a fixing member on which a mold release agent is coated, wherein said apparatus can form an image on a surface of the recording material, a fixing operation of which has been performed by said fixing means, the surface of the recording material being opposite a surface thereof on which the toner image is transferred, and wherein the cleaning blade is arranged so that a normal line of a surface of the cleaning blade is substantially directed in a gravity direction, said surface of the cleaning blade facing an upstream side of an abutting portion of the cleaning blade against said transfer member in a moving direction of said transfer member, and said surface of the cleaning blade facing a direction substantially opposite the gravity direction;

control means for controlling said apparatus so as to transfer a supply toner image formed by said image forming means onto said transfer member directly, and to feed the supply toner image to said cleaning means by said transfer member, wherein a feeding operation of the supply toner image is performed at every predetermined number of times of image formation on the recording material; and humidity detection means for detecting humidity, wherein said apparatus determines the predetermined number according to a detection result of said humidity detection means, wherein the predetermined number is further decreased according to the detection result being higher.

39. An image forming apparatus according to any one of claims 27–38, wherein, said image forming means is composed of at least a toner image forming means and an intermediate transfer member for bearing the toner image formed by the image forming means, and the toner image on said intermediate transfer member is transferred by said transfer member onto the recording material.

* * * * *